US010800495B1

(12) United States Patent
Thomas

(10) Patent No.: US 10,800,495 B1
(45) Date of Patent: Oct. 13, 2020

(54) ENHANCED PLANING DEVICES AND SYSTEMS

(71) Applicant: Paul Thomas, Medfield, MA (US)

(72) Inventor: Paul Thomas, Medfield, MA (US)

( * ) Notice: Subject to any disclaimer, the term of this patent is extended or adjusted under 35 U.S.C. 154(b) by 0 days.

(21) Appl. No.: 14/954,782

(22) Filed: Nov. 30, 2015

Related U.S. Application Data

(60) Provisional application No. 62/085,531, filed on Nov. 29, 2014.

(51) Int. Cl.
*B63B 32/60* (2020.01)

(52) U.S. Cl.
CPC ..... *B63B 32/60* (2020.02)

(58) Field of Classification Search
CPC ... B63B 35/79; B63B 35/7926; B63B 35/793; B63B 32/60; B63B 32/64; B63B 32/66
See application file for complete search history.

(56) References Cited

U.S. PATENT DOCUMENTS 4,561,371 A * 12/1985 Kelley ..... B63B 1/121 114/127
5,809,926 A * 9/1998 Kelsey ..... B63B 1/286 114/274
D528,166 S * 9/2006 Wright ..... D21/769
D593,176 S * 5/2009 Stockstill ..... D21/778
8,967,063 B2 * 3/2015 Coffman ..... B63B 1/248 114/280
D737,392 S * 8/2015 Thomas ..... D21/778
D763,387 S * 8/2016 Pierce ..... D21/778
9,669,905 B1 * 6/2017 Pierce ..... B63B 35/7926
2002/0094733 A1 * 7/2002 Kershaw ..... B63B 35/7926 441/79
2002/0102890 A1 * 8/2002 Bolen ..... B63B 35/7926 441/79
2012/0208415 A1 * 8/2012 Francis ..... B63B 35/7926 441/79
2017/0283016 A1 * 10/2017 Lopez ..... B63B 35/7926

FOREIGN PATENT DOCUMENTS

DE 9418686 U1 * 1/1995 ..... B63B 35/7926
WO WO 8503237 A1 * 8/1985 ..... B63B 35/7926
WO WO-9922986 A1 * 5/1999 ..... B63B 32/60

* cited by examiner

*Primary Examiner* — Ajay Vasudeva

(57) ABSTRACT

The present invention is used in water board sports but maybe of benefit to other water vessels; the present invention assists in the planing of water sport boards; the present invention was initially designed for windsurfing it can be used in surfing, kite-boarding and with other water crafts; the present invention uses one or more hybrid-fins, referred to as Squid-Fins™, along with a new base and fin-box that allows for more adjustments and easier swapping of fins; this system helps the board get up on a plane earlier and stay on that plane longer along with making it possible to add new characteristics to the performance of the board.

13 Claims, 12 Drawing Sheets

ENHANCED PLANING DEVICES AND SYSTEMS

REFERENCE TO RELATED PATENT APPLICATION

This application has the benefit of provisional patent application No. 62/085,531 filed Nov. 29, 2014. and application Ser. No. 14/954,782

TECHNICAL FIELD

This invention relates to board sports and in particular windsurfing, surfing, kiteboarding, and wakeboarding, and the ability to help early planing, hydrofoiling, and control of the board.

BACKGROUND ART

1. There has been growing interest in the development of hydrofoils for board sports.

The prior art of a flying water ski device was one of the first. These devices show the development of a hydrofoil that eventually was used on wakeboards, surfboards, windsurfers, and kiteboards. These devices all try to get the board out of the water and the user must balance on the foil(s) to keep their ride going. If the user tips the board forward there will be a nasty crash and if they tip it back they will stall their foil(s) and probably sink back to the water level or crash. Another problem with a lot of these designs is that many things that might be in the water like seaweed or jelly fish can be caught by the strut or foil and cause a crash or greatly decelerate the rider. To see an example of the current boards and hydrofoils look at AHD boards or Alpinefoil boards as examples, but there are many more. These companies offer different designs and systems for foiling but they all have long struts that go straight down perpendicular to the bottom surface of the board to hold a hydrofoil device and lift you up 2 or 3 feet in the air on the foil.

BRIEF DESCRIPTION OF DRAWINGS

2. There should be some knowledge of board sports, in particular windsurfing and surfing. The drawings will help one to understand this invention.

FIG. 1 is a view from the bottom of an example claimed Hybrid-fin with a hybrid fin-base that 101 shows the hydrofoil blade, 102 shows the leading edge and 103 trailing edge.

3. FIG. 2 shows an example the claimed Hybrid-fin with a Hybrid fin-base in a view from the front. In this example 105 shows claimed Squid-Fin™ with a bend angle of 90 degrees. 106 points to the hydrofoil blade and we are looking at the leading edge.

4. FIG. 3 shows an example of the claimed Squid-Fin™ with a hybrid fin-base in a view from the side with the hydrofoil blade coming out at you. 108 points to a slot in the front of the base to hold the fin securely in the front of an example claimed Hybrid-fin box. 109 points to the hydrofoil blade. 107 points to the slanted back of the base that allows for adjustments in the hybrid-fin box. 110 points to the rake angle of the fin, in this example it is 38 degrees. 111 points to the trailing edge of the fin where it goes down from the base or board when the fin is attached.

5. FIG. 4 shows an example of the claimed Hybrid-fin with a hybrid fin-base in a isometric view. 113 points to the hybrid fin-base. 114 points to a hole for a screw to adjust the rake angle of the fin. 115 points to the slanted back of the fin box that allows for the rake angle adjustment but still hold the fin in the associated hybrid fin-box. 116 points to the slot that hold the front of the fin-base but also allows for it to move back to the pocket in the fin-box. 117 points to the leading edge of the fin. 118 points to the place that a spring would push back on the fin-base.

6. FIG. 5 is side view, FIG. 6 is and isometric view, FIG. 7 is a view from the top where is attaches to the board, and FIG. 8 is from the front and on it's side.

8.

9.

10.

DESCRIPTION/SUMMARY OF INVENTION

Figure 1:
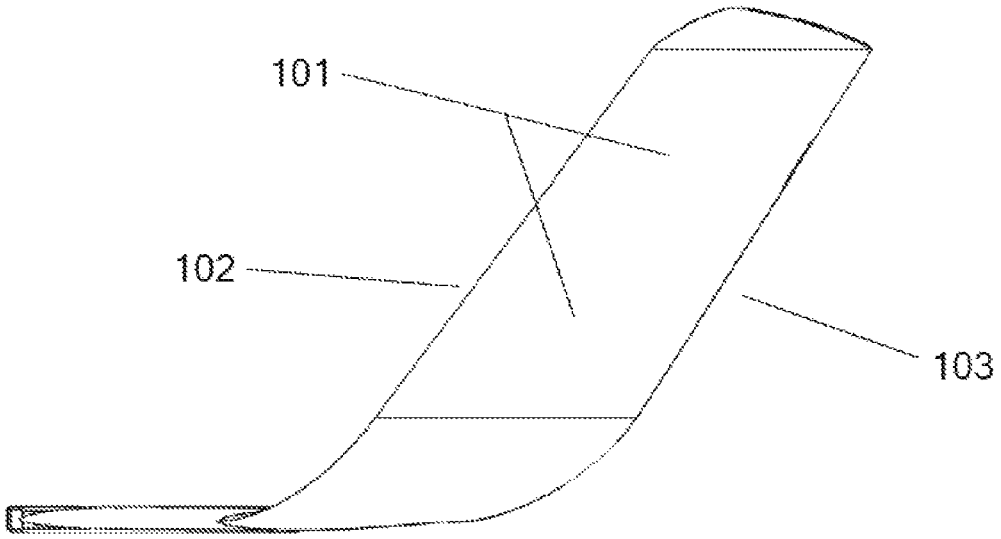
FIGS. 1-4 are views of one example of a Hybrid-fin with the adjustable and easy swap Hybrid-fin base.
Figure 2:
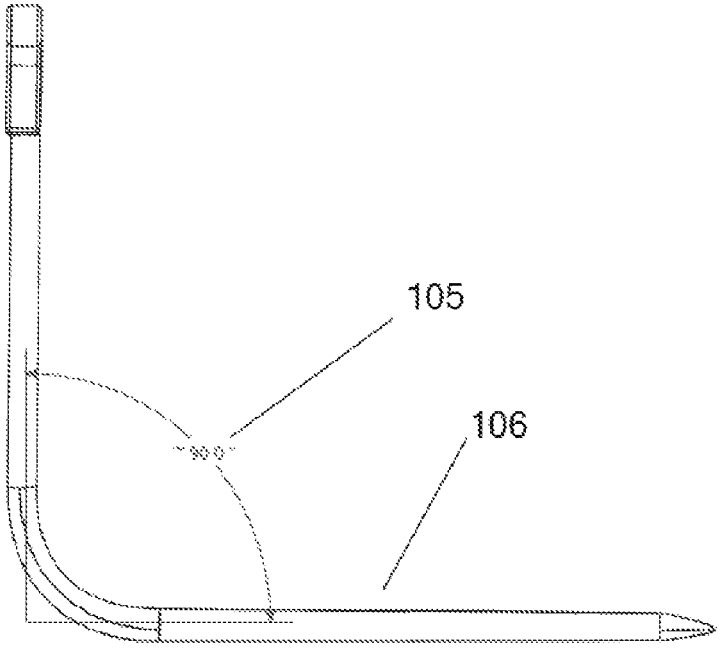

11. What is describe is a different idea. Instead of trying to get the whole board out of the water the Enhanced Planing Assist Device(s) or hybrid-fin(s) known as hybrid fins is a cross between a hydrofoil and a windsurfer or surfboard fin(s) that will assist the board to get on a plane and give the user a faster and smoother ride and also lift board out of the water with appropriate speeds.

12. This technology will revolutionize windsurfing, kiteboarding, surfing, and even wakeboarding. This invention, the Hybrid Fin System, is a way to use hydrofoil technology to assist the board onto a plane with less force. An example embodiment of this invention is the use of two hybrid fins on a windsurfer or surfboard or other water-sport board. The invented hybrid fins are fins that have continuous surfaces that start from the board or board attachment and go down relatively perpendicular to the board's bottom planing surface. The Hybrid-fin then curve as if being bent toward the side or middle of the board. This curve in some embodiments is up to 105 degrees or more and in most would be between +−75 to +−105 degrees. This curve has a large enough radius to give the fin enough strength. In all Hybrid fins there will always be smooth transitions of the surfaces.

After this arc or curve the Hybrid-fin will extend out at that angle for a section with a hydrofoil shape to give the board the lift it needs to get on a plane and then actually Hydrofoil and lift the board above the water surface. The Hybrid-fin will be built of a rigid and strong material so that it will be able to take the forces needed to hydrofoil and not bend more than 7 degrees or break under the pressure. Of course some will be made even stiffer and will bend less than 5 degrees. In some cases the stiffer or more rigid the better so we can make them to bend less than 3 degrees.

13. Many known foil shapes will work, even symmetric foils as used in windsurfing for fins. Note that the Hybrid-fin can have one foil shape on the first section near the board or base and then transition to another foil design in the foiling part (the foil blade section) past the bend. In general, the hybrid fins can use modern CAD and modern production methods to have good transitions from various foil sections. The length of the fin section and the hydrofoil section vary depending on the type of board, the weight of the user, the lift needed to get on a plane or hydrofoil and the speed the board is expected to go.

14. Let us look at windsurfing, wakeboarding, or kiteboarding. In these boarding sports, the board is being driven along by a sail or kite, or the pull of a boat. In all cases the forces are transferred to the board though the user, or in the case of a windsurfer, the user and the mast base. As the board is pushed along on the water the Hybrid-fin will give the board some added lift and help it get up on a plane easier and therefore go faster with less force needed. This equates to less wind needed for windsurfers and kiteboards. It also translates to less strength needed to drive the board and to a smoother ride. Wakeboarders will plane up earlier with a lighter and smoother feel on the board. The smoothness is because some of the lift/planing is being done by the hydrofoil part of the hybrid-fin that is under the water and will not be affected much by the surface roughness. In surfing, the Hybrid-fin System invention will have a similar effect and the Hybrid-fin will help the board plane earlier and stay on a plane longer. The angle of the board forward and back will naturally affect the angle of the Hybrid-fin hydrofoil, so the angle is easily adjustable by the user with a newly designed Hybrid-fin base and Hybrid-fin box.

Figure 10:
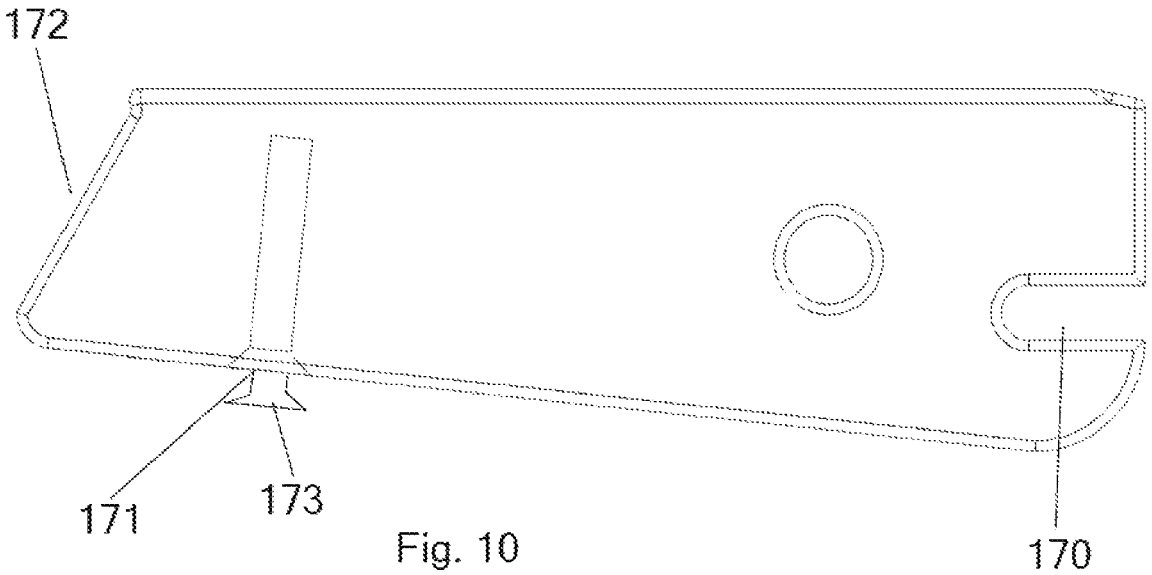
FIG. 10 is a side view of one implementation of a base for the Hybrid-fin showing a slot 170 for holding it in the front and while still being able to change the angle with a screw 173 that could be placed in the hole 171 shown near the back bottom, and also showing the slanted back 172 that holds it down. 172 points to where a spring would push the base back in the fin-box. 173 points to screw that is used to adjust the rake-angle.
Figure 11:
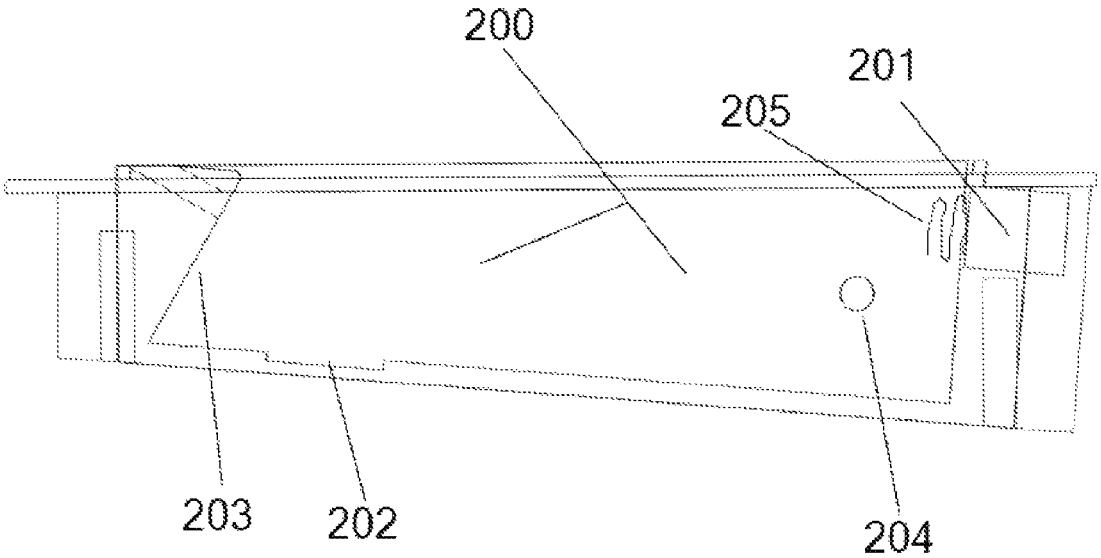
FIG. 11 shows an example of a hybrid fins box 200 that the hybrid fin-base would slide into, Note the cavity/hole 201 in the front for a spring 205 if desired. There also is a notch 202 on the floor of it so a shim could be put there instead of using a screw in the base. 203 is the sloped back pocket that holds the fin in the box. 204 is where a rod is placed that holds down the front of the fin base 7.
Figure 12:
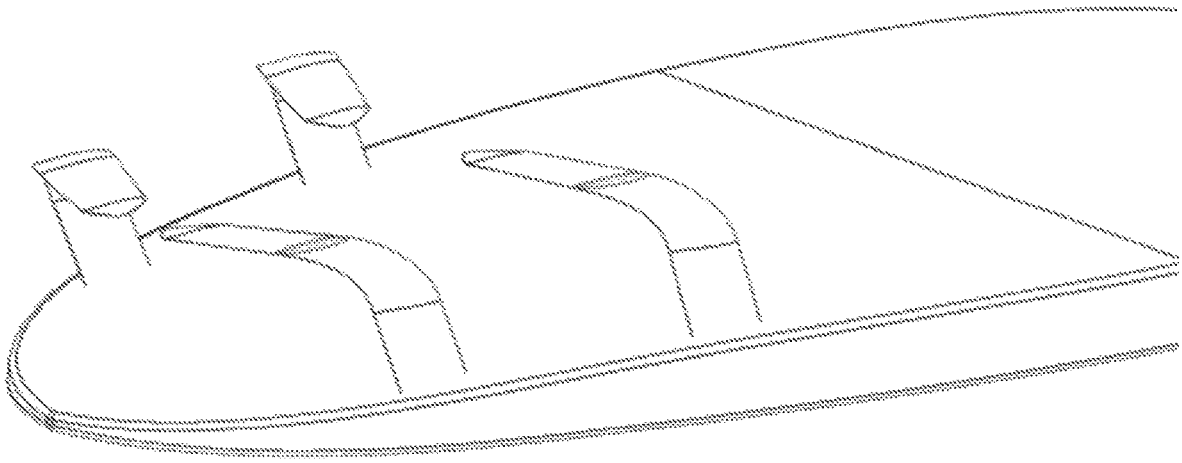
FIG. 12 shows a personal watersport board with a quad setup using example hybrid fins.
Figure 13:
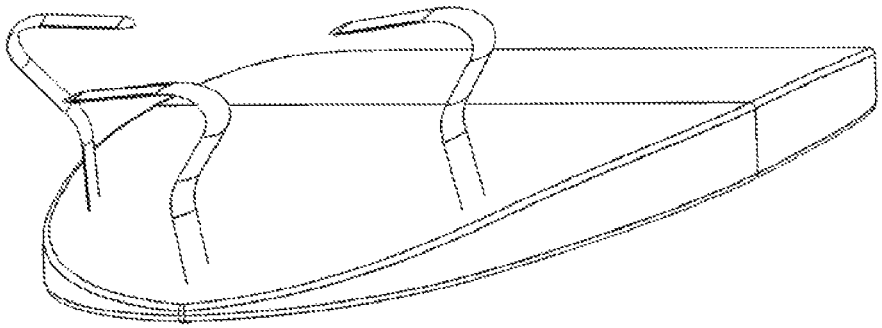
FIG. 13 show a bottom of a personal water sport board with 3 hybrid fins, one in the back middle and a pair further up close to the sides.

15. Another way that these Hybrid-fins help is with debris, such as seaweed. In some embodiments the Hybrid-fins will be swept back to allow seaweed or other troublesome objects to glide off the fin. (Note: the fins could have less of a rake angle and still give a lot of the benefits that the hydrofoil section will give.) For the seaweed benefit, a rake angle of 30 to 45 degrees is desired. There have been other fins or combination of fins that might seem similar but none that are a continuous smooth surface that simply translates from a normal fin to a hydrofoil surface; typically they use appendages on the side of the fin(s). The disclosed invention, Hybrid-fin System, uses the hydrofoil surface to give lift to the board to make it plane earlier and with less driving force. Part of the board is still used as a planing surface and also gives stability to the foiling/planing board, but in some embodiments the board will be out or slightly out of the water. This fuller hydro-foiling in some embodiments would be done with one or more added Hybrid-fins for stability. Current hydrofoil boards typically use a second pair of foils that are smaller behind the main lifting foil(s) to stabilize and balance the foiling. This is done in some embodiments of the Hybrid-fin System. This is why in some embodiments the Hybrid-fin System has a special way to hold the Hybrid-fin to the board that allows for the changing of the angle of the Hybrid-fin and therefore the hydrofoil surface. This Hybrid-fin System with a Hybrid-fin base an example in FIG. 10 & Hybrid-fin box an example in FIG. 11, allows for the change in the forward/back angle. In this new Hybrid-fin box the user does not need to use any tools to swap out fins. The only time the user might use a tool is to change the angle of the fin for a change in the angle of the hydrofoil surface(s). With the Hybrid-fin System the user can use one board and then swap out the fins for regular fins or different sized or angled fins depending on the conditions and expand the capability of the board; therefore the Hybrid-fin System has a better attachment to the board allowing for both changing the angle of the rake of the fin and the foil surface and also allowing for easier swapping of fins. Having it easy and quick to swap out the fins is a huge advantage. Others, such as FCS Fin Company, have developed tool-less fin boxes for surfboard fins but this does not allow for adjustments or take advantage of the natural push against the fin from the water going by it, instead their products put pressure on the side of the box with a roller. The Hybrid-fin System in some embodiments holds the fin at the front in a pocket that it slides into, or with a rod that a slot in the fin base slides into, and then the fin's base can slide back in the box to another pocket at the back of the box. The back pocket can be designed to be sloped 203 along with a slope at the back of the base 115,172 so that the Hybrid-fin's foil angle can be adjusted and still have the fin locked into the base. In some embodiments there is a spring 205 in a pocket 201 in the front to keep the fin firmly pushed to the back pocket 203 even if the water is not pushing against it. The box and fin base are designed so that the front pocket or slot have the right amount of room for the fin to slide back but will still be held by them. So these Hybrid-fins give a user added lift for the user's board, and they help the board to plane up at lower speeds. The Hybrid-fins are designed with different amount of hydrofoil area and for light air they can be fairly big, so they, in some embodiments, are built with carbon fiber epoxy layups giving enough strength for the forces exerted from the foil. These fins also give the designer of the fins and board another way to change the performance of the board.

16. Depending on the angle 105 of the bend in the Hybrid-fins the board will perform differently and will carve and hold turns or jibes as some turns are called in windsurfing. Given different angles of the rake and bend, the user will be able to make a board perform differently in different conditions and uses. There has been a lot of testing and it has been shown that having the fins pointing to the outside of the board with a small bend angle less than 90 degrees going down gives good stability and carving. To make this clear, assume that a bend angle of 90 degrees would be parallel to the relative bottom of the board and that this will go less than 90 by say 5 to 10 degrees. In one embodiment, the fins are pointing in so that they are not sticking out the side of the board. If the fins are pointed in then this angle would be greater and, in fact, the foil section would be getting a little closer to the board at the end of the fin. Of course some might want a looser feel and thus use 90 degrees or a lesser angle. In some embodiments the fins are at the very back of the board allowing the foils to work better giving and getting less turbulence to and from the board.

Figure 14:
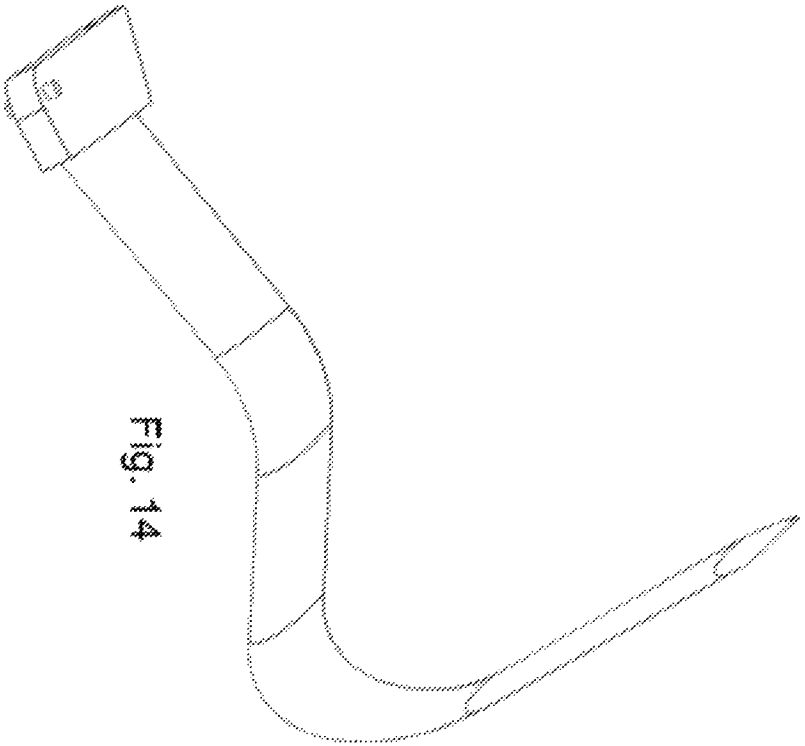
FIG. 14 shows an ISO view of an example hybrid fin where the fin bends to one side and the back to the other and ends with a hydrofoil blade section 240.

17. There are many boards that only use one fin and this hybrid fins System could also be used there, but it might be best if the fin gave a balanced lift and lateral resistance. The easiest way could be to just have the fin go straight down and split into two fins bending out to either side. Another embodiment of the Hybrid-fin System would be to start out with an inverted V from the board allowing it to have two fins going down and then bending out to the side. There could be variations of these two and if they rake back then seaweed would, hopefully, not catch on them. An alternative embodiment is to have the hybrid fins bend or angle to one side of the board and then curve back to the other side, FIG. 14 and FIG. 15. If this type of hybrid fins had a rake angle, again to keep it clear of seaweed, it would also help the planing surface have less turbulence since it could be off the back of the board.

18. There are many embodiments of the present invention of hybrid fins with many shapes. Another example would be a hybrid fins with the fin bending to one side and then the other and even back again to the middle. An alternative embodiment has straight sections in between where it curves to go back to the other side. In one embodiment the curves appear to look like a stretched out "S" or">" but in the preferred embodiment the transitions have good continuous curves for strength.

Figure 9:
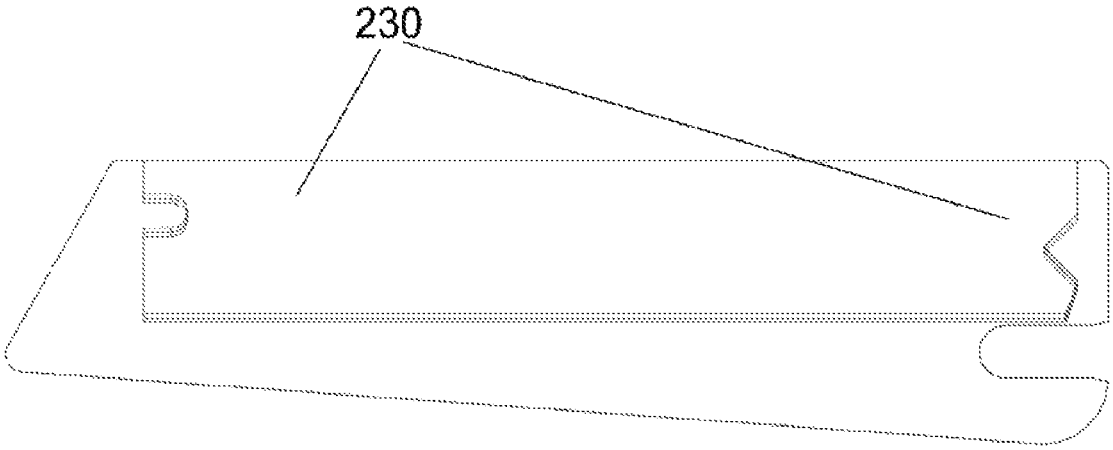
FIG. 9 is a side view of an adapter to allow Future fins to use a Hybrid-fin box. 230 points to the pocket for the Future base.

19. In some embodiments there would be inserts or adapters for existing types of fins or Hybrid-fin with different base type attachments to fit into the Hybrid-fin box so the box and adapter accommodate them. Another embodiment would be a Future™ type fin or Hybrid-fin with a Future base using an adapter FIG. 9 to fit into a Hybrid-fin box. See the side view of an adapter for the Future-Fin™ base to a hybrid fin-base FIG. 9.

20. This is a system for use of Hybrid-fins to help achieve early planning, better board control and enhance the capabilities of boards for board sports. The Hybrid-fin System can supplement a single-finned board with two Hybrid-fin on either side similar to thruster fins, be a single Hybrid-fin, or a twin used in a twin-fin board or even with quad-fin boards. Users can decide what they need for the conditions and type of use they want and swap in the fins they need and the way they need to be adjusted for his board and use. Various embodiments have been used with a single regular fin at the back and Hybrid-fin further forward and near the rails of the board with the bend going in toward the middle or out to or past the edge of the board. The three-fin combination gives a lot of versatility. A user can use just two Hybrid-fin with the fins at the back of the board as some windsurfers or surfboards have and have the bend go away from the middle. There are many uses for the Hybrid-fin System and what is described are merely examples. Many Hybrid-fins could be used together on the same board or mixed with straight conventional fins.

The Hybrid fin system is both a hydrofoil type fin and a fin box that allows for the needed adjustments for the best performance of the foil with the given board. Different boards will have different bottom shapes and therefor the angle that the fin is compared to the water surface will be different and need to be adjusted. Also because of the novel nature of these Hybrid fins and how they will perform differently in different conditions it is very necessary to be able to easily swap them out for other Hybrid fins more suitable for the current conditions. That is why we have designed the Hybrid fins and Lift/Boxes with this new functionality. The basic idea is that the fin should be held into the box in the front part of the box and be able to slide back into a pocket that will hold the fin securely in the box. We have made this pocket have a sloped surface so that the fin could possibly be angled up if needed but still be held in. If that angle is not needed the slope would not be needed either and it could just be a pocket. We previously described the use of a pocket in the front or a rod that the fin would slide into. Another way could be similar to existing fin boxes that have been used for years called the US fin box or Bayne-box. There is slot or long box that has a slot on either side of this box. The fin has a small rod or pin that is just smaller in diameter than these side slots. This rod has been commonly put in the back of the US fin base and there is a over-sized square nut the same width as the above mentioned rod and usually longer in length that a screw in front of the base will screw into. The nut is placed in the slot and slid up to the front, then the screw in the front part of the fin with the US-base is screwed into it. Again the US-box will have a channel or gap that allows the part of the base with the rod to slide into the box and then move to the back of the box. The fin's base is then pushed down into the box and held in with a plate like nut that has been slid into the slot on the pocket of the US box.

Now with the invented Hybrid-fin system a version will have the rod will be in the front of the fin base and there will be a sloped pocket in the back of the box. The Hybrid-fin US base will also be sloped to match that slope. The Hybrid-fin system box could have a spring in the front to help push it back to get a secure fit in that back pocket, sloped or not. This is the same principle as the previously described Hybrid-fin box. So many of these US boxes have the gap for the rod or nut to enter into the box in the middle of the box. This will work well for the Hybrid-fin System US-Box and Hybrid-fin System US-fin-base. We will even have inserts to use exiting US-boxes that will allow them to work with fins made with our Hybrid-fin System US-Base. This will make it so the user can have a tool-less system for their fins. It will make for quick changes of fins and save a lot of time without loosing any functionality. The back insert will be sloped at one end and have a slot for the nut used on US-Boxes with a hole for a screw to secure the back-US-Squid-insert to the back of the US-Box. It could also be made with a cam mechanism to act like the screw and nut. We can also make a front insert for the US-Box that could have a spring allowing the fin to be pushed back into the sloped holding insert more securely. This front-US-insert will also have a screw and nut or cam system. With both of these inserts the user will be able to adjust the location of the fin forward or back. Once it is adjusted the US-Hybrid-fins will pop in and out of the board without a tool. Note the front insert is just for pushing the fin back and in many cases is not needed, in fact by allowing the fin to release with less back pressure on it could be viewed as a safety feature in case of a foot or body part hitting the back of the fin which could be fairly sharp. Since in most cases the water pressure against the fin is from the front or front and side this works well.

Figure 15:
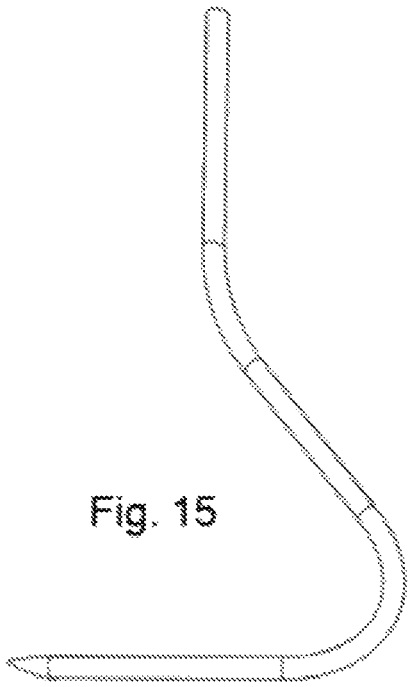
FIG. 15 shows a front view of an example hybrid fin where the fin bends to one side and the back to the other and ends with a hydrofoil blade section 250.

The FIG. 15 shows the insert for the US-box to allow the Hybrid Fins or any fin with this new base to be used and have their adjustable nature.

The FIG. 16 is showing the base for a Hybrid Fins using a US-box or our Hybrid-fin US-box.

The US-box, Bahne-box, or long-board box is a very common box that is well know in the surfing, windsurfing and even SUP community and known to anyone of this art. Please note there could be a larger slot and deeper slot if needed for larger fins.

The Hybrid fin boxes will have inserts for smaller fin bases mainly Future fins or FCS fins that allow them to use these boxes and also allow the fins to be mounted at an angle to the fin-boxes so the fins can be cantered in or out and also angled towards each other, straighter or away from each other. This is possible because of the wider fin boxes. We can also do this for Power-boxes and Tuttle type boxes. Note also we can make the Hybrid fin US-box wider and allow for more flexibility in inserts. The Hybrid-fin US-box can also come in a version that has a deeper cavity and that can be in the whole or the front and or middle section or in a way to give greater strength in holding bigger fins.

Figure 3:
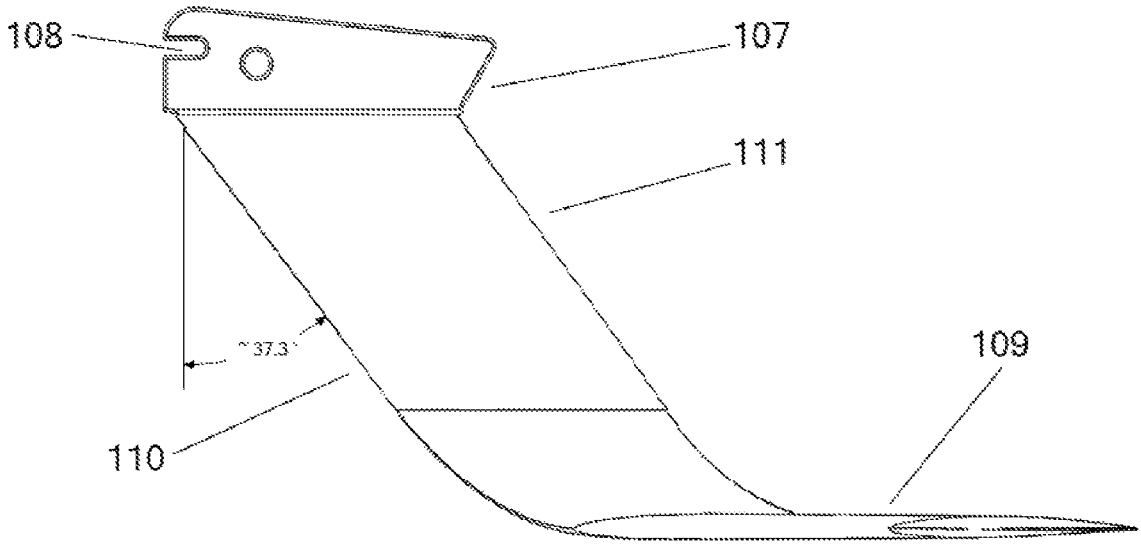
Figure 4:
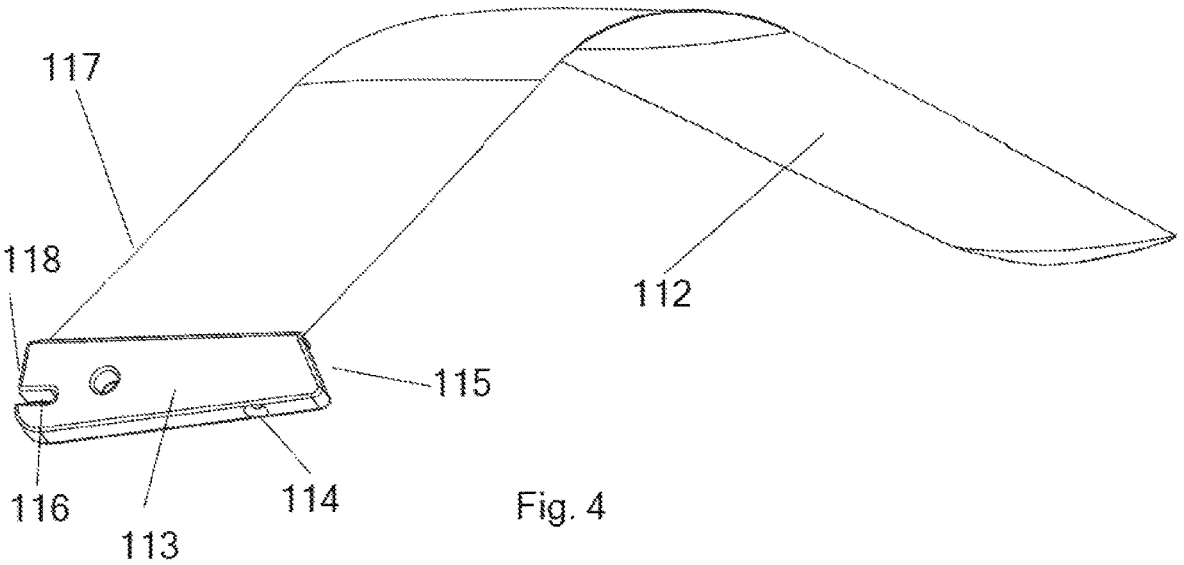
Figure 5:
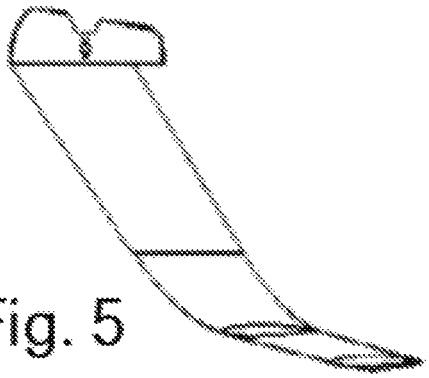
FIGS. 5-8 are views of a Hybrid-fin with a power-box base as an example of various bases.
Figure 6:
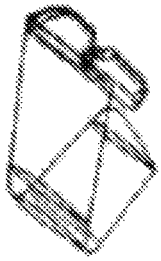
Figure 7:
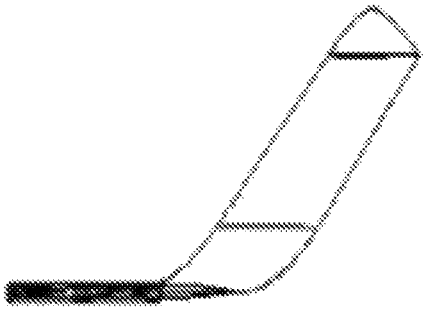
Figure 8:
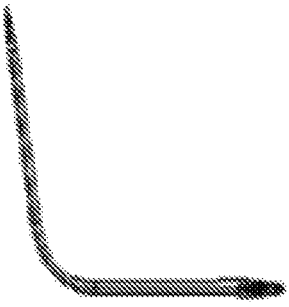

Now also I would like to again explain that the Hybrid-fins will be made in various designs that have hydrofoil type characteristics in these new designs. The Hybrid-fin are a fin that has a hydrofoil at some part of it. This foil will be approximately parallel to the bottom of the board. There can be some left/right angle difference for turning characteristics and as we have discussed the Hybrid-Fins are designed to allow for an adjustment of the hydrofoil angle by the way they are held in the front and the sloped back of the fin-box. We have designed "S" shaped ones that can be used as a single fin or in pairs and will give a loose feeling for better maneuverability but also some lift. FIG. 3 will show one example of this. Note these can curve back to have a flat planing surface that is relatively parallel to the boards bottom or even form something like a "?". Again the Hybrid-fin is a fin that has a hydrofoil section that is relatively parallel to the bottom of the board this is shown in FIG. 4 and these would be used in pairs. In fact these fins could be in multiple ways with existing fins or together in various groupings and foil angles. The more surface area to the hydrofoil section the greater the lift. The lift is of course greater at higher speeds so the size will depend on the wanted lift at a given speed range.

The embodiments of the invention in which an exclusive property or privilege is claimed are defined as follows:

1. A fin system for use with a personal water-sports board, comprising:

at least one fin, the fin having a single base and a single tip;

the fin further having a single leading edge and a single trailing edge extending from the base to the tip;

the fin configured for attachment to an underside of the water-sports board, wherein when attached to the water-sports board, the fin protrudes downwardly from the underside of the board and then bends laterally along a smooth continuous curve towards a lateral side of the board such that a portion of the fin is disposed in a plane that is within +/− 15 degrees of being parallel to the underside of the board; and wherein the entire fin is made of a substantially rigid material.

2. The fin system of claim 1, wherein the personal water-sports board is selected from a group consisting of surfboard, kite-board, sail-board, wake-board, and stand-up paddle board.

3. The fin system of claim 2, wherein the personal water-sports board is one of motorized board and non-motorized board.

4. The fin system of claim 1, wherein the fin comprises a cord extending along the fin base from the leading edge of the fin to the trailing edge of the fin, wherein the cord is aligned substantially parallel to a longitudinal axis of the board.

5. The fin system of claim 1, wherein the fin has a rake angle of between 30 degree and 45 degrees.

6. The fin system of claim 1, wherein the fin comprises an additional lateral bend along a smooth continuous curve to provide the fin an S-shape or a serpentine shape.

7. The fin system of claim 1, wherein the at least one fin comprises plurality of fins.

8. The fin system of claim 7, wherein the plurality of fins comprises two fins configured for attachment on opposing sides of a central longitudinal axis of the board.

9. The fin system of claim 8, wherein the fins have tips pointing toward the central longitudinal axis of the board.

10. The fin system of claim 8, wherein the plurality of fins further comprises an additional fin configured for attachment substantially on the central longitudinal axis of the board and behind the two fins.

11. The fin system of claim 7, wherein the plurality of fins comprises multiple pairs of fins configured for attachment on opposing sides of a central longitudinal axis of the board.

12. The fin system of claim 11, wherein the fins have tips pointing toward the central longitudinal axis of the board.

13. The fin system of claim 11, wherein the plurality of fins further comprises an additional fin configured for attachment substantially on the central longitudinal axis of the board and behind the multiple pairs of fins.

* * * * *